US006540531B2

(12) United States Patent
Syed et al.

(10) Patent No.: US 6,540,531 B2
(45) Date of Patent: Apr. 1, 2003

(54) CLAMP SYSTEM FOR HIGH SPEED CABLE TERMINATION

(75) Inventors: Farrukh S. Syed, McKinney, TX (US); Brent A. Boudreaux, Highland Village, TX (US); Eric C. Peterson, McKinney, TX (US); Richard Schumacher, Dallas, TX (US); Martha G. Peterson, McKinney, TX (US); J. Michael Andrewartha, Plano, TX (US); Jeffrey Todd Haselby, Dallas, TX (US); Kirankumar Chhaganlal Patel, Plano, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/943,924

(22) Filed: Aug. 31, 2001

(65) Prior Publication Data

US 2003/0045140 A1 Mar. 6, 2003

(51) Int. Cl.[7] ..... H01R 4/66

(52) U.S. Cl. ..... 439/98; 439/95; 174/68.3; 248/68.1

(58) Field of Search ..... 439/98, 95, 470, 439/472, 471, 473, 445, 469, 785; 174/40 CC, 65 R, 68.3, 70 R, 135; 248/68.1, 69, 74.1, 74.4

(56) References Cited

U.S. PATENT DOCUMENTS

| | | | | | |
|---|---|---|---|---|---|
| 3,742,119 | A | * | 6/1973 | Newman | 174/48 |
| 4,270,250 | A | * | 6/1981 | Schon | 24/263 |
| H1012 | H | * | 1/1992 | Senatro | 248/68.1 |
| 5,083,929 | A | * | 1/1992 | Dalton | 439/98 |
| 5,122,068 | A | * | 6/1992 | Koss | 439/98 |
| 5,794,897 | A | * | 8/1998 | Jobin et al. | 248/74.4 |
| 5,834,693 | A | * | 11/1998 | Waddell et al. | 174/65 R |
| 5,975,942 | A | * | 11/1999 | Roush et al. | 439/472 |
| 5,996,945 | A | * | 12/1999 | Coles et al. | 248/68.1 |
| 6,053,456 | A | * | 4/2000 | Dispenza | 248/56 |
| 6,235,989 | B1 | * | 5/2001 | Suthmann | 174/48 |

* cited by examiner

*Primary Examiner*—P. Austin Bradley
*Assistant Examiner*—Ross Gushi

(57) ABSTRACT

A shielded cable assembly contains a hardpoint that resists damage arising from possible collapse of the shielded cable assembly under strong compressional forces that are exerted by a clamp assembly in the form of a separable block having first and second opposed members. The hardpoint contains a conduit that protects a data transfer line or cable bundle by compressing electromagnetic shielding between the conduit and the clamp assembly.

17 Claims, 4 Drawing Sheets

CLAMP SYSTEM FOR HIGH SPEED CABLE TERMINATION

RELATED APPLICATIONS

This application is related to copending and cofiled applications for U.S. Pat. Ser. No. 09/944,537, filed Aug. 31, 2001 and entitled SHIELDED CABLE SYSTEM FOR HIGH SPEED CABLE TERMINATION; Ser. No. 09/945,069, filed Aug. 31, 2001 and entitled CABLE SHIELD TERMINATION SYSTEM USING CLAMPS AND FERRULES.

BACKGROUND OF THE INVENTION

1. Field of the Invention

The invention pertains to the field of shielded cables for use in high speed data transmissions and associated cable retention mechanisms. More specifically, ground receptacles are used in mounting the cables to electrical housings or chassis in a manner that minimizes electromagnetic interference (EMI).

2. Discussion of the Related Art

Cables for use in transmitting electronic signals are often provided with shielding in the form of foil, wire mesh or screen material that surrounds one or more central insulated leads. One common example of this type of cable is the coaxial cable that is used to carry television or data transmissions; however, in computer applications, there are often a plurality of data transfer lines in the form of a cable bundle. The shielding itself is usually covered with an external layer of insulation or a protective outer layer. The shielding protects the wanted signal that is being transmitted on the central lead from ambient electromagnetic disturbances. The shielding also limits the amount of electromagnetic disturbance that is transmitted outwardly from the central lead. For these reasons, shielded cables are increasingly utilized in densely packed arrays of electrical equipment.

A variety of connectors are used to secure and interconnect these cables. Typically, bulkhead connectors, which connect the shielding to a ground proximate the terminus of the cable, are used for shielded cables. Nevertheless, it is not always desirable or practical to connect the cable to ground solely at its terminus. For example, U.S. Pat. No. 5,975,953 to Peterson describes the difficulties and special considerations that are involved when connecting electromagnetic interference (EMI) shielded cables directly to an input/output (I/O) card and having to shunt the ground path through the I/O card.

Further, in the case of bulkhead connectors, a continuing problem exists with securing the cables against unwanted motion that can, for example, cause signal degradation by torsional or translational motion of the cable. Prior systems are unable to secure the cable against unwanted motion while providing a ground for the EMI shielding. Separate structures, such as a rubber grommet that is separate from the bulkhead connector are often used to limit such motion, but constitute poor electrical conductors and may facilitate EMI leaks from an otherwise closed EMI housing.

Regulatory agencies are promulgating ever stricter regulations that increasingly limit the amount of EMI which electronic equipment may generate. Additionally, stricter EMI limits are necessarily imposed by the practicalities of operating computer and telecommunications systems at increasingly faster rates of data transmission. Whenever a cable passes through the wall of an electrical housing or chassis, the opening may provide an unacceptable EMI leak.

Increasingly, it is necessary to seal openings electrical housings, in order to prevent EMI leaks. At he same time, it is useful to be able establish EMI seals at multiple optional locations on a single cable construction, to reduce the number of unique cable constructions which would otherwise have to be manufactured and stocked, and to configure these as needed at the time of installation.

SUMMARY OF THE INVENTION

The present invention overcomes the problems that are outlined above by providing a mount,, such as a clamp assembly for use in establishing a grounded connection between a shielded cable and a chassis. The grounded connection is located where the grounded connection passes through an electrical housing or chassis and the clamp assembly advantageously seals the EMI enclosure at the point of passage. The clamp assembly advantageously permits the shielded cable to have electronically continuous shielding through the clamp and the chassis.

The clamp assembly comprises a separable block defining at least one aperture. The separable block includes at least two pieces, for example, including a first member that defines a first portion of the aperture and a second member that defines a second portion of the aperture, such that the aperture is completely defined when the first member and the second member are deployed opposite one another. The aperture is appropriately sized to compress the shielded cable for establishing the grounded connection. As used herein, the term "separable block" includes the use of members that are not connected with one another, as well as blocks where the members are connected by a hinge or pivot to form a bivalve clamp assembly.

The separable block may, for example, comprise a forward face and a rearward face The first member and the second member may comprise complimentary mating structure, such as mirror image complimentary L-shapes, for alignment of the first member and the second member to assist in defining the aperture when the first member and the second member are deployed opposite one another. The two members are held together and compress the cable by means of assembly screws or other fasteners that pass through one member to engage the other.

The first portion of the aperture may comprise a first plurality of pressure ridges, and the second portion of the aperture may comprise a corresponding plurality of second pressure ridges in compressional alignment with the first plurality of pressure ridges. These pressure ridges are used for gripping the shielded cable.

A mounting plate may contain a receptacle that is configured for retaining the first member and the second member in deployment opposite one another. The mounting plate may also contain electromagnetically conductive gasketing which, when compressed by the clamp assembly and its mounting fasteners, forms an electromagnetic seal between the clamp assembly and the mounting plate.

The first member and the second member may each form a generalized L-shape with a leg of the generalized L-shape containing a hole. Respective threaded fasteners may pass through the holes of the legs for use in mounting the first member and the second member onto the mounting plate.

A method of installing the shielded cable provides a secure and reliable grounded connection between a chassis and the separable block. An outer portion of the shielded cable is removed to create an exposed section of electromagnetic shielding; the first member and the second member are placed around the exposed section of electromagnetic shielding such that the exposed section of electromagnetic shielding resides within and contacts the aperture. The first member and the second member are assembled together using screws or other fasteners to compress the electromagnetic shielding within the aperture; this assembly is then inserted into the mounting plate. Threaded fasteners are used to drive the clamp assembly against the mounting plate to compress the electromagnetic gasketing between the clamp assembly and the mounting plate and establish the grounded connection.

DETAILED DESCRIPTION

The following detailed description illustrates a preferred embodiment of a shielded cable that contains hardpoints for use in establishing grounded connections over predetermined intervals that are located, for example, where the shielded cable passes through an electrical housing or chassis. The use of a preferred example should not be construed to impart undue limitation to the concepts that are disclosed herein because the teaching is by way of example and not by limitation.

Figure 1:
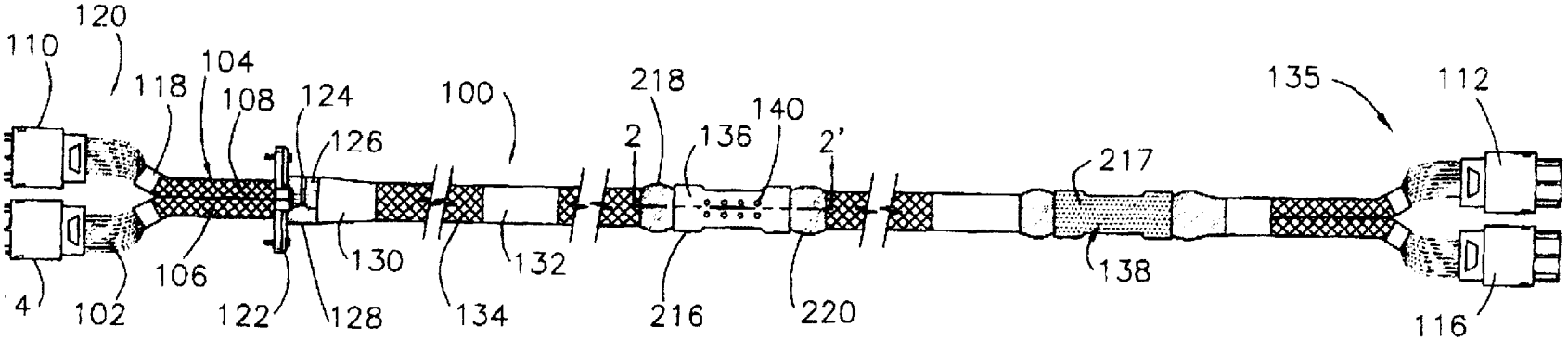
FIG. 1 depicts a shielded cable that contains hardpoints for use in establishing a grounded connection between the shielded cable and an electrical housing or chassis.

FIG. 1 depicts a shielded cable 100 for use in high speed data transmission. The cable 100 includes at least one data transfer line, such as data transfer line 102, which preferably but optionally forms part of a first cable bundle 104 comprising a plurality of such data transfer lines. Additional cable bundles, such as a second cable bundle 106, may travel coextensively with the first cable bundle 104. Each of the cable bundles 104 and 106 may be surrounded by a protective covering, such as an insulator or sheath 108. The respective data transfer lines 102 are coupled at remote ends with corresponding first data couplings 110 and 112 in the case of first cable bundle 104, and second data couplings 114 and 116 in the case of second cable bundle 106. The protective covering 108 is optionally secured to the first cable bundle 104 through use of adhesively back electrical tape 118.

A first end 120 of shielded cable 100 may, for example, be used for coupling with an input/output bay (not shown). A conventional bulkhead mounting bracket 122 is optionally used to secure the first end 120 with a grounded connection being established between the input/output bay and shielded cable 100 through use of a clamp 124 that compresses electromagnetic shielding 126 against the bulkhead mounting bracket 122. Shrink wrap 128 is optionally provided to cover the electromagnetic shielding 126, which is typically formed of braided metal strands or foil, for purposes of containing metal strand of fragments that could break free from the electromagnetic shielding 126. An elastomeric cable reinforcer 130 is also optionally provided to prevent cable motion from fatiguing the electromagnetic shielding with resultant degradation of the grounded connection between the electromagnetic shielding 126 and the bulkhead mounting bracket 122. Labeling, such as label 132, may optionally be used to provide indicia with descriptive information concerning the type of shielded cable 100, as well as information concerning its use and operating characteristics.

An outer sheath 134, such as an insulator or plastic mesh, surrounds and packages the shielded cable 100. A second end 134 of shielded cable 100 may connect, for example, with electrical components inside a cabinet that houses a central processor (not shown). Hardpoints 136 and 138 are provided on the shielded cable 100 at selected locations covering intervals where the shielded cable 100 is intended to pass through a chassis or electrical housing (not shown). By way of example, the chassis or electrical housing may be the housing for the input/output bay or the central processor cabinet that have been previously described.

Figure 2:
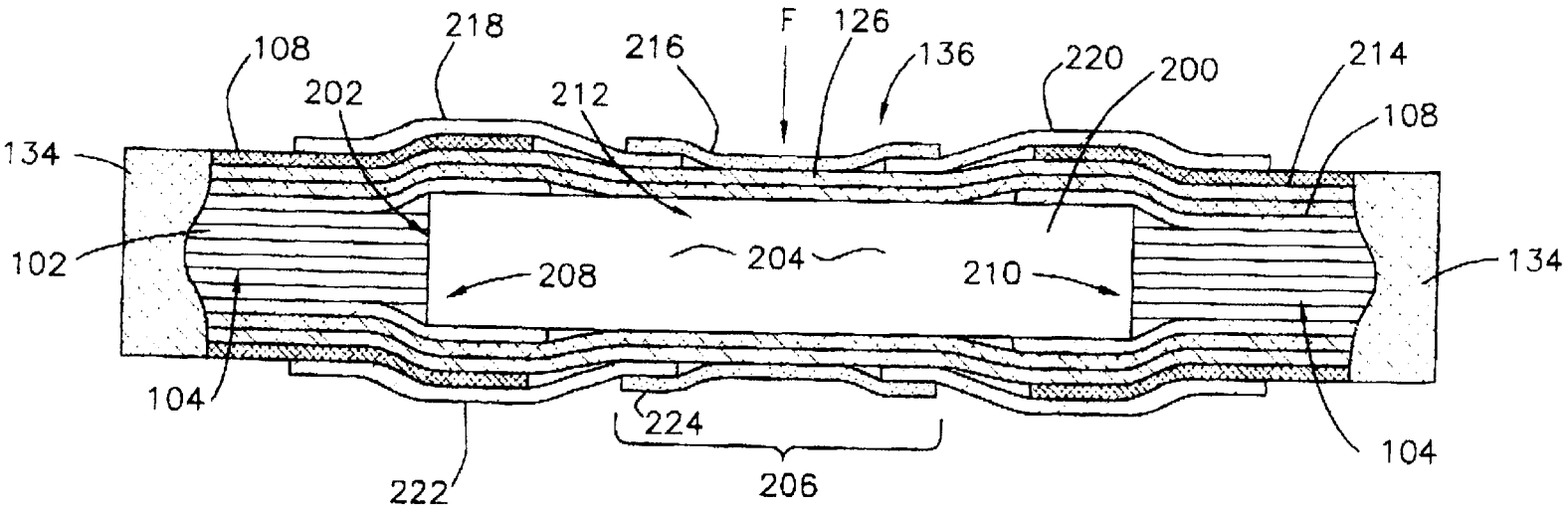
FIG. 2 depicts a midsectional view of one of the hardpoints taken along line 2–2' of FIG. 1.

FIG. 2 is a midsectional view taken along line 2–2' of FIG. 1. A conduit 200 surrounds the first cable bundle 104 and data transfer line 102. The conduit 200 defines an interior passageway 202 through which the first cable bundle 104 passes. Conduit 200 protects the first cable bundle 104 from potential damage due to external compressive forces F. As shown in FIG. 2, conduit 200 has a circular cross-section that solely accommodates interior receipt of the first cable bundle 104. Conduit 200 may alternatively have any other shape, such as an oblong cylindrical, or ovaloid crosssection (not shown) that accommodates both the first cable bundle 104 and the second cable bundle 106, which may also be combined into a single cable bundle within the interior passageway 202. Conduit 200 presents an exterior side 204 that is surrounded by the electromagnetic shielding 126. PVC plastic is an especially preferred material for use in making conduit 200.

The protective covering 108 and the outer sheath 134 are absent, i.e., discontinuous, over a section or portion 206 radially outboard of conduit 200. A first end 208 of conduit 200 passes beneath the protective covering 108, as does a second end 210, but a middle section 212 of conduit 200 is not covered by the protective covering 108 or the outer sheath 134. An insulative material 214, such as adhesive-backed electrical tape, is optionally wrapped around conduit 200 with mutual overlapping reinforcement against the protective covering 108 to secure conduit 200 in place.

In the arrangement shown, the electromagnetic shielding 126 would be uncovered and exposed, except for the provision of a selectively detachable tube 216, a first shrink wrap 218 segment, and a second shrink-wrap segment 220. The first and second shrink-wrap segments 218, 220 respectively overlap the first and second ends 208 and 210, extending inwardly over the middle section 212 beyond the protective layer 108 and the outer sleeve 134. Additional selectively detachable tubes may be provided on other hardpoints, such as tube 217 on hardpoint 138.

The selectively detachable tubes 216 and 217 comprise a tear-away material, such as a low-shear shrink-wrap or plastic coating. As shown in FIG. 1, a plurality of holes 140 are provided at distances that are selectively spaced apart from one another to facilitate removal of the selectively detachable tubes 216 and 217. Tubes 216 and 217 are to be removed only when a clamp assembly is to be installed at that location. One or more such tubes may be used in a given cable construction to support multiple optional clamp installations.

The first and second shrink-wrap sections 218 and 220 are optional components that contain any metal fragments which, otherwise, could devolve from the electromagnetic shielding 126. The first and second shrink-wrap sections 218 & 220 generally reinforce hardpoint 136 proximate the first and second ends 208, 210. The first and second shrink-wrap sections 218 and 220 respectively overlap the outer sleeve 134, as at portion 222, and underlap the selectively detachable tube 216, as at portion 224.

There will now be shown a clamp assembly for use in establishing a grounded connection between the shielded cable 100 and an electrical housing or chassis over the intervals of hardpoints 136 and 138. Again, a variety of clamp assemblies may be used, and the demonstration of a preferred example should not be construed to impart undue limitation to the concepts that are disclosed herein because the teaching is by way of example and not by limitation.

Figure 3:
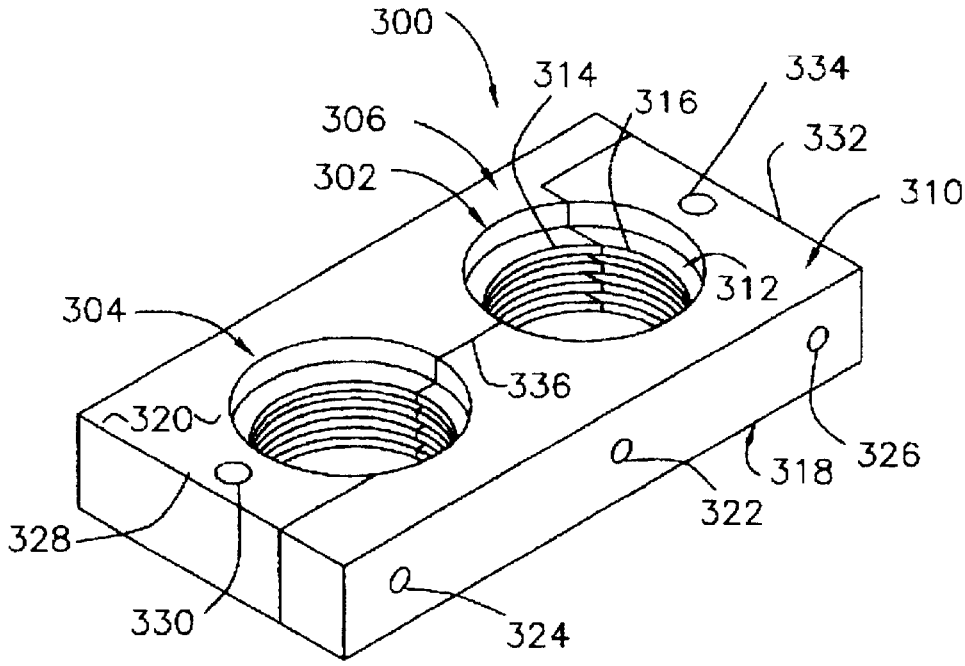
FIG. 3 depicts a separable block comprising a first member and a second member for use as a clamp assembly in attaching the hardpoint shown in FIG. 2 to the electrical housing or chassis.

FIG. 3 illustrates the clamp assembly in the form of an electrically conductive separable block 300 defining at least one aperture 302. The separable block 300 may in an identical manner also define additional apertures, such as aperture 304. A first generally L-shaped member 306 defines a first portion 308 of the aperture 302. A second generally L-shaped member 310 defines a second portion 312 of the aperture, such that the aperture 302 is completely defined when the first member 306 and the second member 310 are deployed opposite one another. The first portion 308 and the second portion 312 have respective diameters, preferably equal diameters, that accommodate the diameter of hardpoints 136 and 138 (see FIG. 1) after a portion of the selectively detachable tube 216 is removed. The first portion 308 and the second portion 312 of aperture 302 contain a series of continuous pressure ridges, such as ridges 314 and 316, that oppose one another to exert compressive forces on the hardpoints 136 and 138. Electrical contact between the separable block 300 and the electromagnetic shielding 126 is sufficient for establishing a grounded connection under the influence of these compressive forces. The first portion 308 and the second portion 312 are mirror images of one another.

The separable block 300 comprises a forward face 318 and a rearward face 320. Holes 322, 324, and 326 are provided for receipt of threaded fasteners that couple the first member 306 with the second member 310. The first member 306 presents a first side leg 328 that contains a hole 330 which is used to accommodate a threaded fastener (not shown). The second member 310 presents a second side leg 332 that contains a hole 334 which is also used to accommodate a threaded fastener (also not shown).

A gap tolerance along cut line 336 facilitates relative positioning of the first and second members 306, 310, to adjust the separation of these members across aperture 302 in varying the magnitude of compressive force F (see FIG. 2) as the electromagnetic shielding 126 is compressed between the conduit 200 and aperture 302 under the influence of threaded fasteners in each of holes 322–326. This gap is closed to zero as the first and second members are assembled onto the cable hardpoint and compressed onto the cable shield as the clamp assembly fasteners are tightened.

Figure 4:
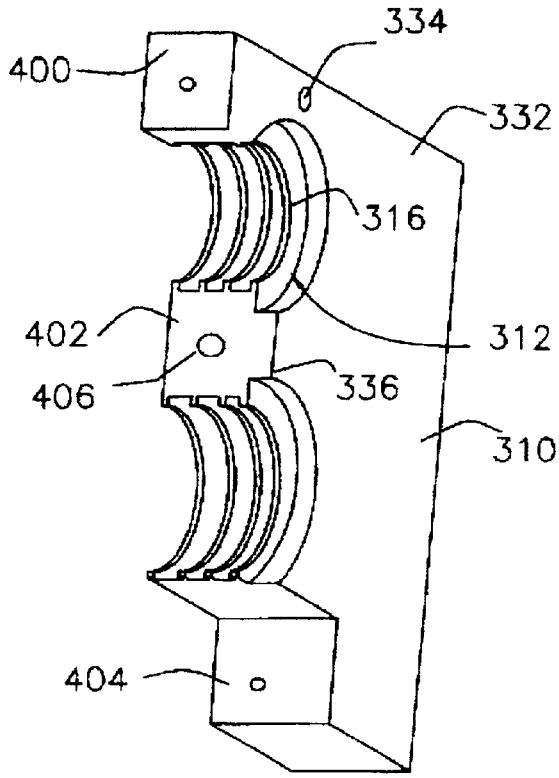
FIG. 4 depicts the second member of the separable block.

FIG. 4 depicts the second member 310 and reveals faces 400, 402, and 404, which follow cut line 336. These faces comprise holes, such as hole 406, in alignment with each of holes 322–326 for receipt of threaded fasteners.

Figure 5:
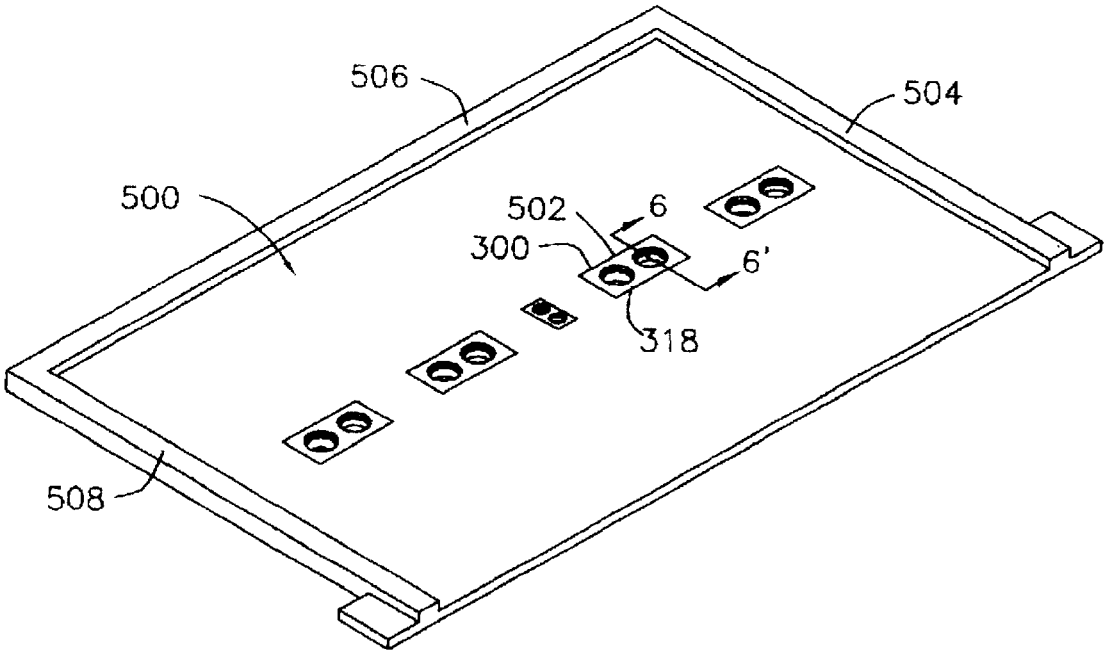
FIG. 5 depicts the separable block within a mounting panel that forms part of the electrical housing or chassis.

FIG. 5 depicts a front view of cable mounting panel 500, which contains a receptacle 502 that receives the separable block 300. The mounting panel 500 is part of an electrical housing or chassis. Mounting panel 500 contains mounting structure, such as channel bearing surfaces 504, 506, and 508, that cooperatively mate with other portions (not shown) of the electrical housing or chassis to provide an EMI enclosure.

Figure 6:
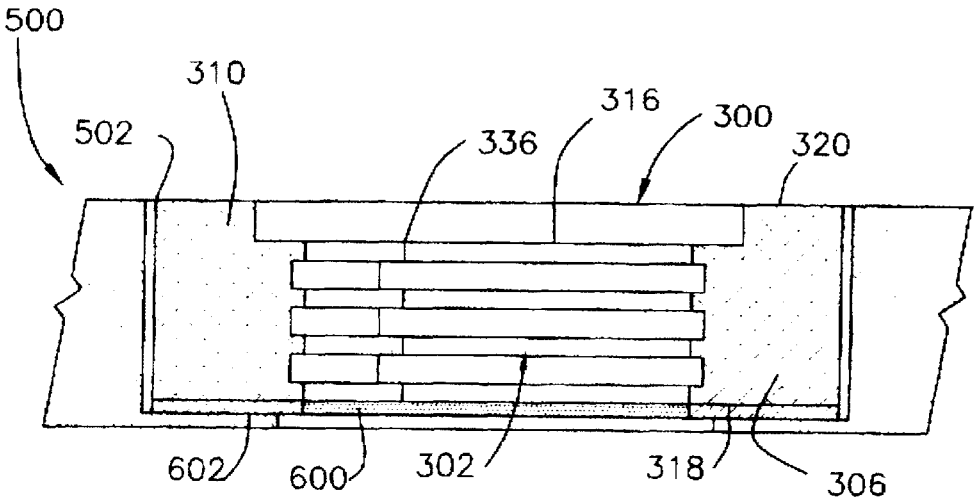
FIG. 6 is a midsectional view of the separable block within the receptacle taken along line 6–6' of FIG. 5.

FIG. 6 is a midsectional view taken along line 6–6' of FIG. 5. An electrically conductive mechanically compliant gasket 600 is provided within receptacle 502, either facing forward face 318 as shown in FIG. 6, or around the periphery of the receptacle facing separable block 300 to form an EMI seal. A forward overhanging lip 602, which may also be a separate backing plate, is threaded for receipt of threaded fasteners through, for example, holes 330 or 334 as shown in FIG. 3, and functions to retain the separable mounting block 300 in place within receptacle 502.

Figure 7:
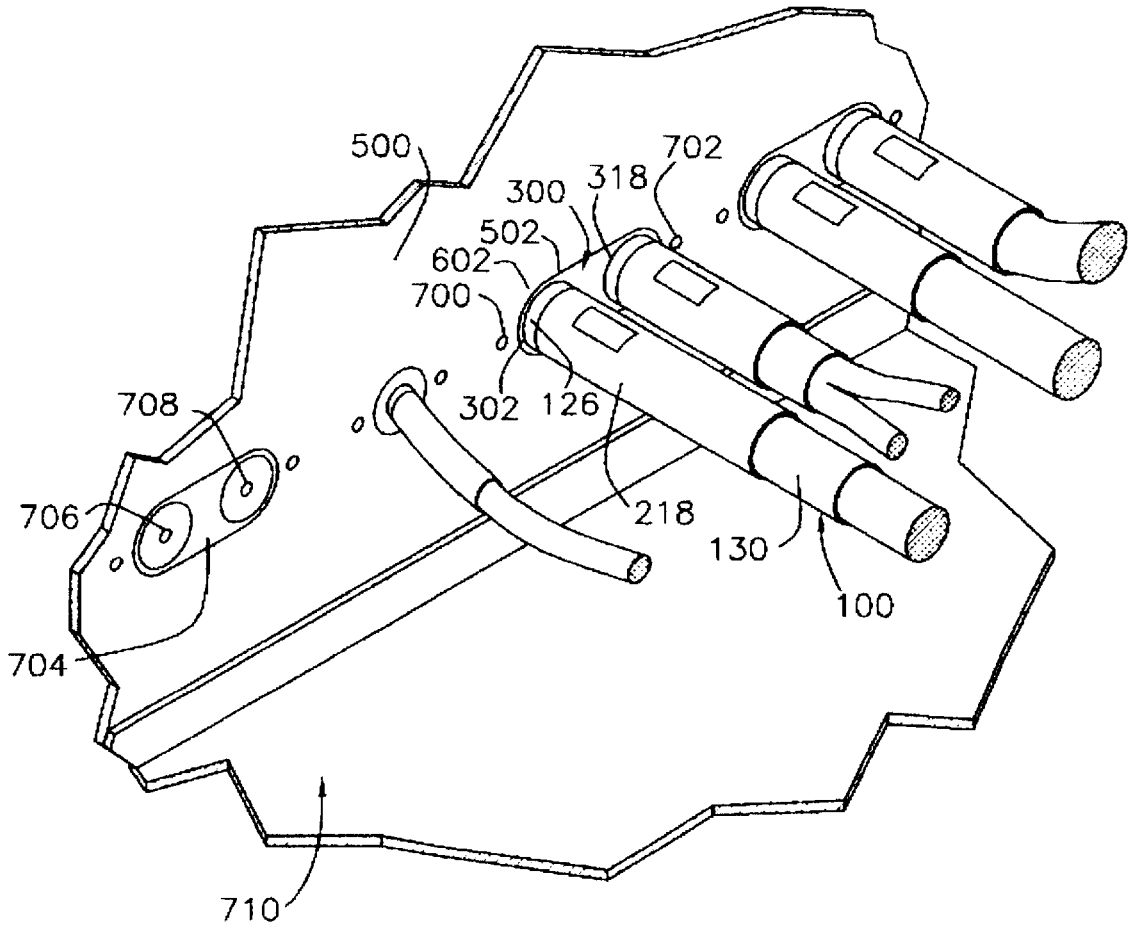
FIG. 7 is a rear view of the clamp assembly including the separable block with the shielded cable installed to ground.

FIG. 7 depicts a rear view of mounting panel 500 with separable block 300 installed in receptacle 502 and shielded cable 100 installed in aperture 302. Threaded fasteners 700 and 702 are threaded into the overhanging lip 602 for retention of the separable block 300 within receptacle 502. A separable block 704 is identical to separable block 300, except a pair of plug blanks 706 and 708 are installed therein to seal an EMI enclosure 710.

In operation, the shielded cable 100 is grounded to the mounting panel 500 by separating the first and second members 306, 310 of separable block 300, and removing the selectively detachable tube 216 to accommodate the thickness of aperture 302, to create an exposed section of electromagnetic shielding 126 over hardpoint 134. The first member 306 and the second member 310 are placed around the exposed section of electromagnetic shielding 126 such that the exposed section of electromagnetic shielding 126 resides within the aperture 126. The first member 306 and the second member 310 are bolted together and inserted into the receptacle 502 of mounting plate 500. Threaded fasteners 700 and 702 are then installed to retain the separable mounting block in receptacle 502. An electrical ground contact is established between the separable block 300, electromagnetic shielding 126, the threaded fasteners 700–702, overhanging lip 602, gasket 600, and mounting plate 500.

The foregoing discussion is intended to illustrate the concepts of the invention by way of example with emphasis upon the preferred embodiments and instrumentalities. Accordingly, the disclosed embodiments and instrumentalities are not exhaustive of all options or mannerisms for practicing the disclosed principles of the invention. The inventors hereby state their intention to rely upon the Doctrine of Equivalents in protecting the full scope and spirit of the invention.

What is claimed is:

1. A shielded cable grounding device for use in establishing a grounded connection between a shielded cable and a chassis, comprising:

an electrically conductive, separable block defining at least one aperture, and including structure for releasable attachment to the chassis;

the separable block comprising a first generally L-shaped member defining a first portion of the aperture and a second generally L-shaped member defining a second portion of the aperture, the first generally L-shaped member and the second generally L-shaped member mated to form the separable block having a greater width dimension than a thickness dimension where the thickness dimension is coextensive with a longitudinal axis of the shielded cable when the shielded cable is clamped within the aperture; and the aperture being appropriately sized to compress the shielded cable for establishing the grounded connection through the separable block to the chassis.

2. The shielded cable grounding device as set forth in claim 1, wherein the first generally L-shaped member and the second generally L-shaped member of the separable block are connected by threaded fasteners.

3. The shielded cable grounding device as set forth in claim 1, wherein the first generally L-shaped member and the second generally L-shaped member have all legs of the respective generalized L-shapes extending in transverse orientation with respect to the longitudinal axis of the shielded cable when the shielded cable is clamped within the aperture.

4. The shielded cable grounding device as set forth in claim 1, wherein the first generally L-shaped member and the second generally L-shaped member comprise complimentary mating structure for alignment of the first generally L-shaped member and the second generally L-shaped member to assist in defining the aperture when the first generally L-shaped member and the second generally L-shaped member are deployed opposite one another.

5. The shielded cable grounding device as set forth in claim 1, wherein the first portion of the aperture comprises a first plurality of pressure ridges and the second portion of the aperture comprises a corresponding plurality of second pressure ridges in compressional alignment with the first plurality of pressure ridges.

6. The shielded cable grounding device as set forth in claim 1, comprising a shielded cable within the aperture.

7. The shielded cable grounding device as set forth in claim 1, the separable block further comprising:

a second aperture appropriately sized to compress a second shielded cable for establishing the grounded connection through the separable block to the chassis, the separable block presenting at least one straight edge, the aperture and the second aperture being located relative to one another such that a single line drawn through a diameter of the aperture and a diameter of the second aperture is parallel to the straight edge.

8. The shielded cable grounding device as set forth in claim 1, comprising a mounting plate configured for retaining the first generally L-shaped member and the second generally L-shaped member in deployment opposite one another.

9. The shielded cable grounding device as set forth in claim 8, comprising an electrically conductive gasket interposed between the separable block and the mounting plate to form an EMI seal.

10. The shielded cable grounding device as set forth in claim 8, wherein the first generally L-shaped member and the second generally L-shaped member each have all legs of the generalized L-shape extending in transverse orientation with the longitudinal axis of the shielded cable when the shielded cable is clamped within the aperture.

11. The shielded cable grounding device as set forth in claim 10, comprising holes in the legs of and threaded fasteners passing through the holes for use in mounting the first generally L-shaped member and the second generally L-shaped member onto the mounting plate.

12. The shielded cable grounding device as set forth in claim 11, wherein the first generally L-shaped member and the second generally L-shaped member comprise complimentary mating structure for alignment of the first member and the second member to assist in defining the aperture when the first generally L-shaped member and the second generally L-shaped member are deployed opposite one another.

13. The shielded cable grounding device as set forth in claim 12, wherein the first portion of the aperture comprises a first plurality of pressure ridges and the second portion of the aperture comprises a corresponding plurality of second pressure ridges in compressional alignment with the first plurality of pressure ridges.

14. A method of installing a shielded cable to establish a grounded connection with a chassis through use of a shielded cable grounding device that includes a separable block having a first generally L-shaped member and a second generally L-shaped member that meet to define an aperture, the method comprising the steps of:

removing a portion of the shielded cable to create an exposed section of electromagnetic shielding;

placing the first generally L-shaped member and the second generally L-shaped member around the exposed section of electromagnetic shielding such that the exposed section of electromagnetic shielding passes longitudinally through the aperture with all legs of the first generally L-shaped member and the second generally L-shaped member extending in transverse orientation to the longitudinal axis of the shielded cable;

assembling the first and second generally L-shaped members together to compress the exposed shielding and establish a grounded connection and form an electromagnetic seal;

inserting the first generally L-shaped member and the second generally L-shaped member into a mounting plate, and securing the separable block against the mounting plate.

15. The method according to claim 14, wherein the step of securing the separable block comprises compressing compress a mechanically complaint electrically conductive gasket between the separable block and the the mounting plate to establish a grounded connection and electromagnetic seal.

16. The method according to claim 14, wherein the step of removing a portion of the shielded cable comprises tearing a selectively detachable material to a predetermined length corresponding to a thickness of the separable block.

17. The method according to claim 14, wherein the shielded cable comprises a hardpoint that includes a conduit beneath the electromagnetic shielding, and the step of driving comprises compressing the electromagnetic shielding between the conduit, the first generally L-shaped member, and the second generally L-shaped member.

* * * * *